US005758446A

United States Patent [19]

Atchison

[11] Patent Number: 5,758,446

[45] Date of Patent: Jun. 2, 1998

[54] FIRED BULLET IDENTIFICATION SYSTEM

[76] Inventor: Richard G. Atchison, 28905 NE. Sunset Falls Rd., Yacolt, Wash. 98675

[21] Appl. No.: 524,093

[22] Filed: Sep. 7, 1995

[51] Int. Cl.[6] ..... F41A 21/12; F41A 21/18

[52] U.S. Cl. ..... 42/78; 42/1.01; 102/501; 102/430

[58] Field of Search ..... 42/78, 76.02, 1.01, 42/76.01; 102/501, 430; 89/16, 14.05

[56] References Cited

U.S. PATENT DOCUMENTS

| | | | |
|---|---|---|---|
| 3,562,945 | 2/1971 | Mikola | 42/78 |
| 4,035,942 | 7/1977 | Wiczer | 42/1.01 |
| 4,175,346 | 11/1979 | Zemsky | 42/78 |
| 5,177,318 | 1/1993 | Martinez et al. | 89/46 |
| 5,341,720 | 8/1994 | Franzen et al. | 89/45 |
| 5,479,737 | 1/1996 | Osbornet et al. | 42/76.01 |

FOREIGN PATENT DOCUMENTS

| | | | |
|---|---|---|---|
| 2559239 | 7/1977 | Germany | 42/78 |
| 270630 | 1/1930 | Italy | 42/78 |

*Primary Examiner*—Stephen M. Johnson

*Attorney, Agent, or Firm*—Alfred E. Miller

[57] ABSTRACT

The present invention relates to the fire arm industry and more particularly to a system that impresses a bar type code into the lead bullet that has been fired from a gun. The identifying markings are placed on the gun barrel lands with as little visibility as possible but enough to form the code to identify the fired bullet as being from one specific handgun or rifle. The code markings may be placed on the barrel, without effecting its operation in any way. The microscopic identifying code markings are impressed in to the surface of the lands of the gun barrel and when the firearm is fired the force of the firing forms this particular gun's code on the bullet. These identifying code markings may be placed at the intersection of the chamber and the barrel so that when a bulletted cartridge is placed in the chamber and the gun is fired, the code marks are encoded on both the neck of the brass and the lead bullet surface, forming identical codes. The identifying code markings are similar to bar code markings and directly relates the spent casing that has been fired by a firearm to the lead bullet from that casing shell and to the firearm that fired it. The system of the present invention is especially useful for criminal investigations of a crime scene in which a firearm was used.

6 Claims, 2 Drawing Sheets

FIRED BULLET IDENTIFICATION SYSTEM

FIELD OF THE INVENTION

The present invention relates to the field of lead bullet marking, especially for the field of criminal investigation.

CROSS-REFERENCE TO RELATED APPLICATION

My copending United States Patent Application, Ser. No. 08/524,092 filed of even date is related to this present application and discloses a system for bar type code identification of a spent brass casing that remains after a firearm is fired. The system of my copending application may be used in connection with the system of the present invention and is entitled: Bullet Cartridge Casing Identification System

BACKGROUND OF THE INVENTION

The following art has been found to be related to the field of the present invention but in no way does any of the herein cited references anticipate or even suggest the novel advance in the art that is made by the present invention.

U.S. Pat. No. 4,035,942, issued to Weizer on 19 Jul. 1977 and entitled Bullet Identification, relates to a device that is installed on the inside surface wall of a gun barrel. This invention can mark a bullet with a code but it also can, with continued use and neglect, become the cause of the barrel to explode. The system in the Weizer Patent alters the barrel substantially and as such, makes the barrel unusable if an attempt to remove it is made. The Weizer system would leave debris in the barrel unless it is cleaned after each firing, this is a very dangerous condition. The system of Weizer is so obvious to the eye that if the user is a criminal, he would most certainly attempt to remove it, thereby creating even a more dangerous condition.

U.S. Pat. No. 4,175,346, issued to Zansky on 27 Nov. 1979 and entitled Firearm and Bullet Identification, relates to a system that also substantially alters the interior of the barrel. The barrel of the firearm is altered to such a degree that any bullet that is fired through such an altered barrel would lose enough velocity so as to leave the bullet that was fired lodged in the barrel and this is a very dangerous situation. In addition, the bullet would be so changed in shape that its accuracy would be minimal. The cost of such a change in the firearm barrel would be prohibitive and would add additional weight to the barrel and make it impracticable, undesirable and dangerous.

OBJECTS OF THE INVENTION

An object of the present invention is to provide a system of marking the bullet fired from any type of firearm, with an identifying bar type code in order to relate, with certainty, that bullet with that particular firearm.

A further object of the present invention is to provide a system of marking the bullet with identifying bar type code that is safe and does not effect the firing of the firearm.

An additional object of the present invention is to provide a system of marking the bullet with an identifying bar type code that does not effect the accuracy of the bullet that is fired.

A still further object of the present invention is to provide a system of marking the bullet with an identifying bar type code that is relatively inconspicuous to a gun user.

Various other objects, advantages and features of the present invention will become apparent to those skilled in the art from the previous and following discussions, taken in conjunction with the accompanying drawings, which constitute part hereof.

SUMMARY OF THE INVENTION

The present invention is a system to impose an identifying marking code, similar to a bar code which is defined in Random House International Unabridged Dictionary, 2nd Edition 1993, on a bullet that is fired from a firearm to identify that that bullet was fired from a particular firearm. The identifying code of the present invention is imposed with as little visibility as possible and is almost invisible to the user. The present invention is accomplished by imposing microscopic ridges and/or groves in the lands of a barrel that are already there from the boring of the barrel. Identifying marks that are only on that barrel are left on the lead bullet when it is fired from that firearm. It is also contemplated to have marking on both barrel and matching marks in the neck of the chambers, so that the spent cartridge shell neck and the fired lead bullet will have matching codes.

When the bullet is fired, the tremendous force that is created, causes the causes the ridges and/or the grooves machined in or on the barrel's lands and/or the chamber neck to impress its particular design on the surface of the fired bullet and/or the spent cartridge neck.

The identifying system used herein can be used on all types of firearms firearms, a single shot type gun, a semi-automatic and even a fully automatic assault weapon, semi automatic guns are not assault weapons.

The identification system of the present invention does not, in any way, interfere with the operation of any firearm, does not cause any dangerous situation to accrue and there is no effect on the accuracy or the velocity of the bullet that is fired from the weapon so marked with the inconspicuous microscopic ridges and/or grooves in a gun barrel of the present invention. The markings are of a depth of from about 0.00510 centimeters to about 0.0310 centimeters

DETAILED DESCRIPTION OF THE PREFERRED EMBODIMENT OF THE PRESENT INVENTION

Figure 1:
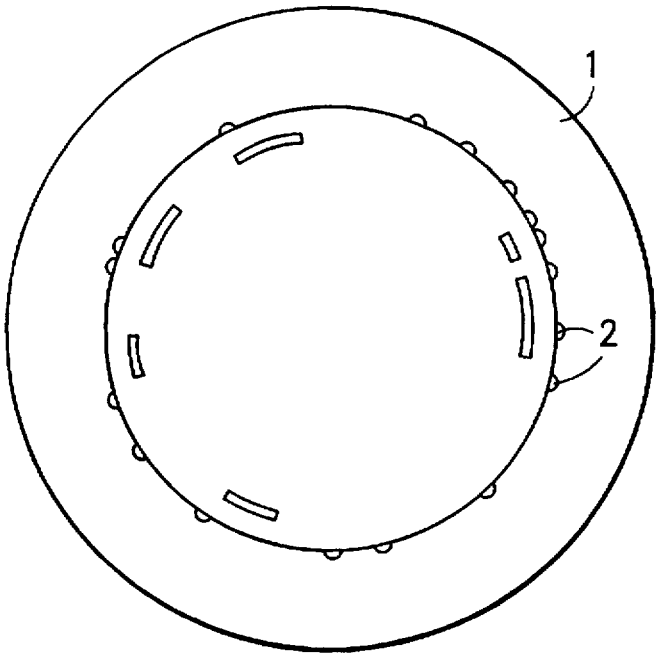
FIG. 1, is a cross-sectional view of a gun barrel showing the ridges and/or grooves of the present invention that have been placed on the lands of said barrel.

Referring now to FIG. 1, the gun barrel is shown at 1 and the ridges and/or groves of the present invention, placed in the interior of the lands of the barrel are shown at 2.

Figure 2:
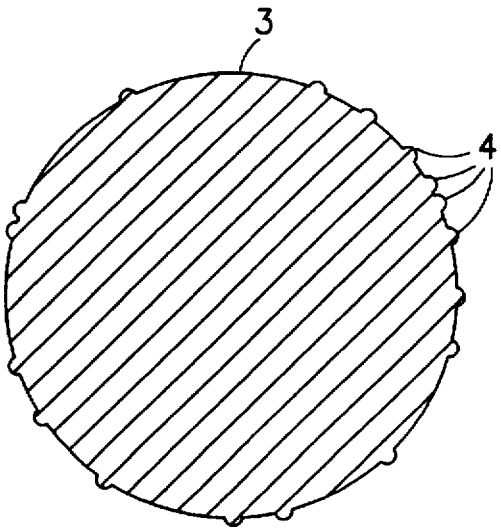
FIG. 2, is a cross-sectional view of a bullet with the ridges of the present invention shown on the surface of a bullet fired from a barrel, so coded as shown in FIG. 1
Figure 3:
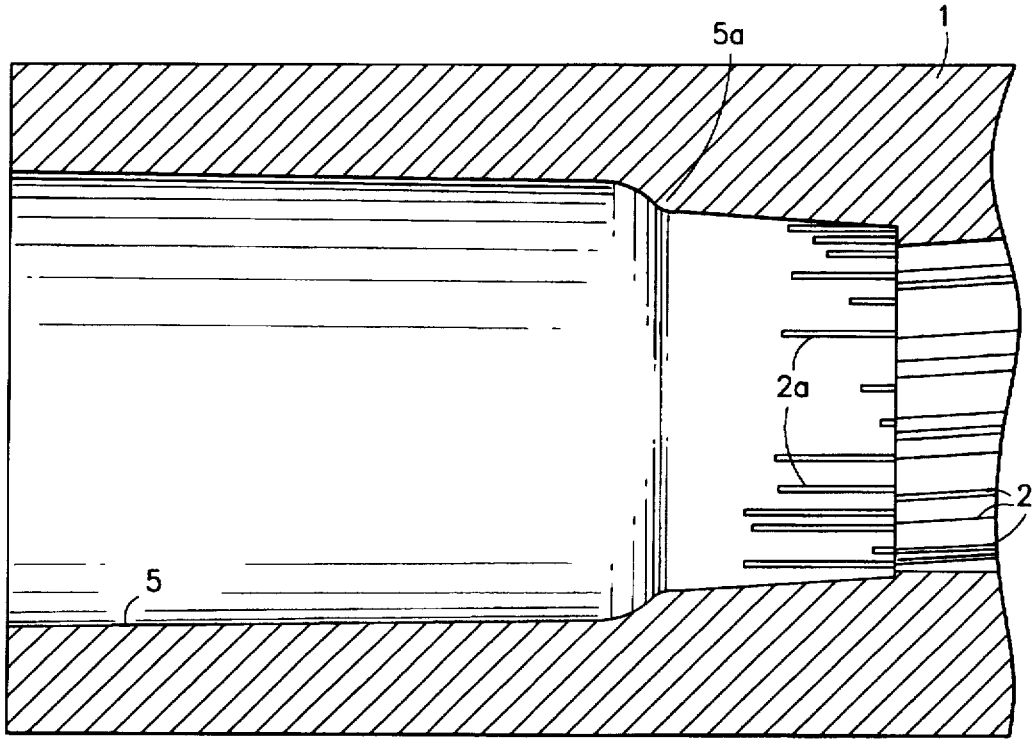
FIG. 3, is an interior plan view of a gun chamber and barrel showing the matching ridges and/or groves of the present invention that are placed on the interior of the chamber and barrel's lands of a gun, thereby allowing the positive identification of gun and the bullet fired from that gun.

FIG. 2, shows a cross-section of a bullet fired through a gun barrel code marked as shown in FIG. 1 supra., at 3, showing the ridges and/or the grooves 4 of the present invention imposed on the surface of said bullet surface FIG. 3. shows the interior of a gun chamber 5 and barrel 1 with the neck of the chamber at 5*a* and the ridges and/or grooves of the present invention at 2 in the barrel 1 and the matching ridges and/or grooves in the neck 5*a* of chamber 5.

Figure 4:
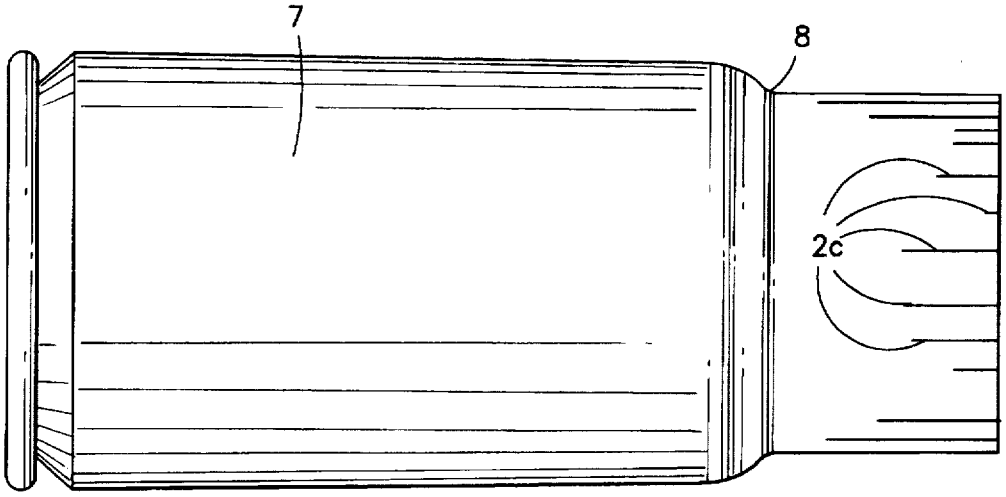
FIG. 4, is a plan view of a spent brass casing cartridge shell that has been fired from a firearm that has the bar type code of ridges or grooves of the present invention placed in its chamber neck.

FIG. 4. shows a spent brass shell 7 with the neck portion thereof at 8 and the ridges and/or the grooves of the present invention are shown imbedded on the surface of said spent shell 7.

The microscopic identifying ridges and/or grooves used in the identifying bar type code markings of the present invention may be of any width and depth as desired. These ridges and/or groves of the present invention may be engraved or embossed on the neck of the chamber or the lands of the barrel of any type of fire-arm whether it be a single shot hand gun or rifle, a multibarreled rifle or a semi-automatic hand gun or rifle. Even a fully automatic machine gun or assault weapon (assault weapons are only automatic), hand gun, rifle (no semi-automatic weapon is an assault weapon) can be identifiably marked with the ridges and/or grooves of the present invention.

When a gun is coded with identical microscopic matching markings on both the neck of the spent brass shell and on the surface of the fired bullet, there is no better evidence in criminal investigation of a shooting. The gun used, the spent shell and the fired bullet become one.

While the description supra., contains many specificities, the reader should not construe these to be limitations on the scope of the invention, but merely as exemplifications of a preferred embodiment of the present invention. Those skilled in the art will envision that many other possible variations are within the scope of the present invention. For example, skilled artisans will readily be able to change the dimensions and the materials of the various embodiments. They can make many variations on the design of the present invention. Accordingly, the reader is requested to determine the scope of the present invention only by the scope of the appended claims and their legal equivalents, taken in view of the scope this specification, and not by the examples that have been given herein.

What is claimed is:

1. A system for identifying a bullet and a gun from which said bullet was fired, said gun having lands in the barrel comprising impressing microscopic ridges and/or grooves markings on the lands of said barrel and matching microscopic markings on the neck portion of the chamber of said gun, said markings impressed on the bullet and on the neck of the spent cartridge shell left in the chamber of said gun upon the firing of said gun.

2. The system of claim 1 wherein the markings imposed on the surface of the bullet fired and the surface of the spent shell cartridge are identical.

3. The system of claim 2 wherein the markings imposed on the surface of the bullet fired and the surface of the spent shell cartridge are in the form of readily recordable and identifiable bar code markings.

4. The system of claim 3 wherein the microscopic bar code markings impressed into the lands of the barrel of said gun and into the surface of the neck portion of the chamber of said gun are a depth of from about 0.00510 centimeters to about 0.0130 centimeters.

5. The system of claim 4 wherein the bar code markings on the lands of the barrel and the surface of the neck portion of the chamber and the resulting markings impressed in the fired bullet and the neck of the spent shell cartridge are in the form of grooves and/or ridges of varying width and depths.

6. A system for identifying a bullet and a gun that has lands in its barrel, from which said bullet was fired, said gun having microscopic ridges and/or grooves bar code markings of varying widths and depths, said microscopic markings impressed into the lands of the barrel of said gun and into the surface of the neck portion of the chamber of said gun at a depth of from about 0.00510 centimeters to about 0.0130 centimeters, and said markings imposed on the surface of the bullet fired, and the neck of the spent cartridge, the markings on the lands of the gun barrel and chamber are in the form of readily recordable and identifiable bar code markings being identical to the markings imposed on the surface of said bullet and on the neck of the spent shell cartridge left in the chamber of said gun upon the firing of said gun.

* * * * *